United States Patent [19]

Wheeler

[11] 4,434,590

[45] Mar. 6, 1984

[54] FLASHING STRUCTURE FOR GEODESIC DOME STRUCTURES

[76] Inventor: Roger B. Wheeler, 2604 N. 4th St., Clinton, Iowa 52732

[21] Appl. No.: 225,856

[22] Filed: Jan. 16, 1981

[51] Int. Cl.[3] ..... E04D 1/38

[52] U.S. Cl. ..... 52/58; 52/81

[58] Field of Search ..... 52/58, 81, DIG. 10, 52/60, 540, 542, 827, 527, 535, 478, 518, 537, 57

[56] References Cited

U.S. PATENT DOCUMENTS

| | | | |
|---|---|---|---|
| 3,481,094 | 12/1969 | Taylor | 52/522 X |
| 3,555,756 | 1/1971 | Curran et al. | 52/478 X |
| 3,660,952 | 5/1972 | Wilson | 52/81 |
| 3,858,372 | 1/1975 | Wilson | 52/81 |
| 4,160,345 | 7/1979 | Nalick | 52/81 |

*Primary Examiner*—Carl D. Friedman
*Attorney, Agent, or Firm*—Robert S. Smith

[57] ABSTRACT

A building construction includes a first triangular member having a generally planar first side and a second triangular member having a generally planar second side dimensioned and configured for engagement with the first side abutting planar contact. A first flashing element is disposed on the first member and extends along the first side. The first flashing element has a laterally extending step disposed intermediate first and second generally planar sections. The first generally planar section is fixed to the first triangular element and the laterally extending step is disposed in generally parallel relationship to the first side. A second flashing element is disposed on the second member. The second flashing element includes first and second generally planar surfaces disposed proximate to a step shaped section thereof. The step shaped portion thereof extends in generally parallel relationship to the second side. The step shaped portion of the second flashing element is disposed spaced away from the second side and cooperates with the step shaped portion of the first flashing element.

7 Claims, 9 Drawing Figures

FLASHING STRUCTURE FOR GEODESIC DOME STRUCTURES

BACKGROUND OF THE INVENTION

The invention relates to building construction and particularly to a flashing construction intended to prevent leakage at various joints. While the invention has particular application to geodesic domes structures, it will be understood to also have application to other structures. Geodesic dome structures have been utilized for many years and are being used increasingly as dwelling places. To enclose any given number of feet of floor area, the surface area of the dome will have less surface area than any conventional rectangular structure. This is highly advantageous not only in terms of initial building costs but also in terms of heating costs. Such structures have natural air flows on the inside and offer little wind resistance on the outside. An additional advantage of such structures is that no columns or beams are required for support and accordingly great flexibility in interior design including wall and furniture placement is possible.

The prior art includes Pierrepont U.S. Pat. No. 1,330,609 which discloses a flashing for window and door frames having some general similarity to the apparatus in accordance with the invention. The apparatus differs in that it is intended for construction members which are fixed together at the time of installation of a flashing. In contrast, the apparatus in accordance with the invention is intended for installation on prefabricated assemblies which are then shipped to an assembly site for final assembly.

Such structures have, in the past, been manufactured by assembling a number of triangular sections at a job site and then applying, at the job site, shingles to the exterior surface. This has the substantial disadvantage that the economic advantages inherent in prefabricating individual triangular sections (completed with shingles) is not possible. An additional disadvantage is that the person who is erecting the home must deal with the additional inconvenience of shingling the exterior of the home. This is of greater significance in such homes than in conventional rectangular structures because each of the large number of joints must be very carefully sealed and in addition the individual who is erecting the home may be a "do-it-yourselfer" who does not have extensive experience even in shingling conventional homes. The shingling of triangular sections disposed at a wide variety of orientations is, of course, enormously more complex than the shingling of conventional homes.

The number of joints involved and the complexity of the interfaces between the various sections will be more apparent by consideration of the geometry of a typical dome shaped building. Such homes, in some forms, are manufactured of sixty individual triangular elements. The triangular elements are provided in two basic sizes and interface to define sets of triangular elements which define five pentagons and five hexagons. Individual triangular sections, even with shingles disposed thereon, can be moved by a crew of three men without the requirement for a crane. The triangular sections are bolted at the job site.

It is a primary object of the invention to provide a flashing structure for geodesic dome structures which will enable the application of shingles to individual triangular sections at a central factory.

It is another object of the invention to provide a structure of this type which will facilitate the easy assembly of the prefabricated triangular panels even by those who do not have substantial experience in such assembly operations.

It is another object of the invention to provide apparatus which is simple and inexpensive to manufacture.

SUMMARY OF THE INVENTION

It has now been found that these and other objects of the invention may be attained in a building construction which includes a first triangular member having a generally planar first side and a second triangular member having a generally planar second side dimensioned and configured for enagagement with the first side in abutting planar contact. A first flashing element is disposed on the first member and extends along the first side. The first flashing element has a laterally extending step disposed intermediate first and second generally planar sections. The first generally planar section is fixed to the first triangular element and the laterally extending step is disposed in generally parallel relationship to the first side. A second flashing element is disposed on the second member and includes first and second generally planar surfaces disposed proximate to a step shaped section thereof. The step shaped portion thereof extends in generally parallel relationship to the second side. The step is disposed spaced away from the second side.

The first generally planar section of the first flashing element may be disposed in oblique relationship to at least a part of the step shaped portion of the first flashing element. The first and second members may be generally planar and may be disposed in oblique relationship. A course of shingles may extend over the first flashing element and extends beyond the first side. The shingles may also be disposed on the second member and may extend in end abutting relationship to the step shaped section of the second flashing element. The first and second members may be disposed with the second planar section of the first flashing element and the second planar section of the second flashing element in abutting planar contact.

Means for sealing may be disposed intermediate the step shaped section of the first flashing element and the step shaped section of the second flashing element. The means for sealing may comprise a strip of caulking material or an elastomeric seal.

BRIEF DESCRIPTION OF THE DRAWING

The invention will be better understood by reference to the accompanying drawing in which.

DESCRIPTION OF THE PREFERRED EMBODIMENT

Figure 1:
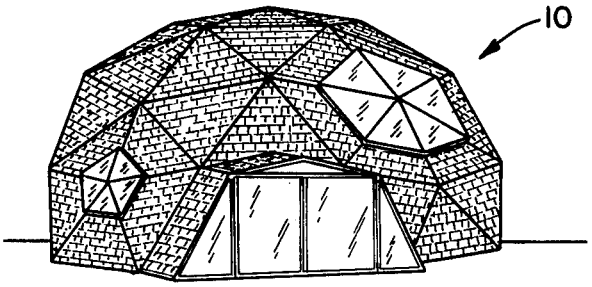
FIG. 1 is an elevational view of a dome structure of the general type to which the invention has particular application.
Figure 3:
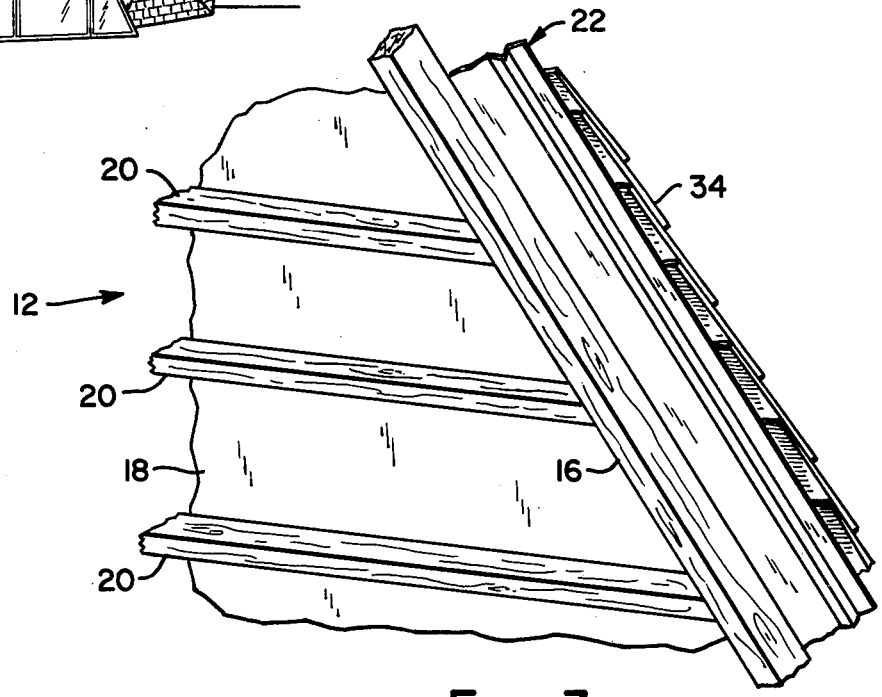
FIG. 3 is a fragmentary perspective view of the underside of a second triangular member illustrating the surface thereof which cooperates with the side of the first triangular section illustrated in FIG. 2.
Figure 2:
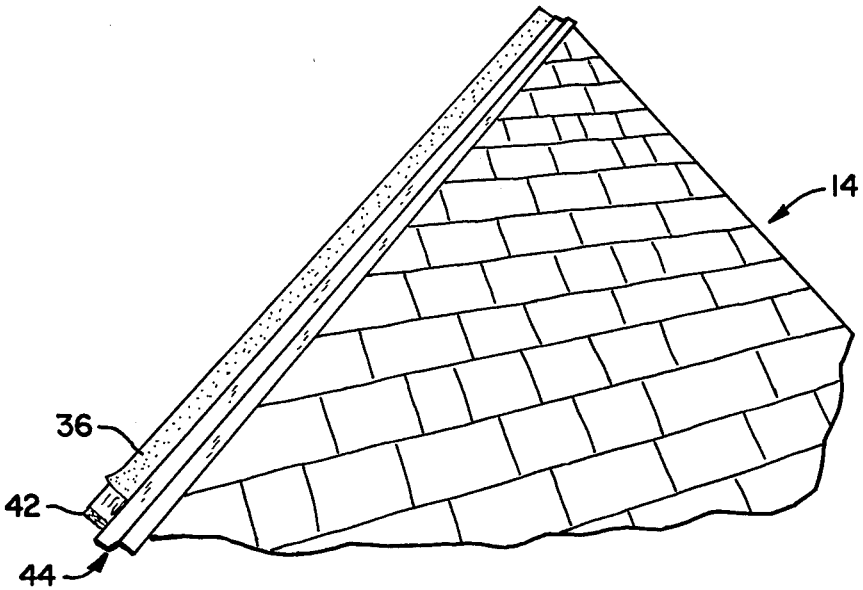
FIG. 2 is a fragmentary perspective view of a first triangular member which illustrates one surface of that triangular member and the relationship thereto to the shingles disposed thereon.

Referring now to FIG. 1 there is shown a geodesic dome structure 10 which is manufactured of first and second prefabricated triangular members 12 and 14 illustrated in FIGS. 2, 3, 4, and 9. It will be understood that the geodesic dome structure 10 is ordinarily constructed of two basic types of generally triangular members. Each type will have substantially the same dimension. The manner in which the flashing for individual types is applied to the individual triangular members will vary depending upon the ultimate location of that triangular member in the geodesic dome 10. For example, it will be seen in FIG. 1 that there are triangular sections which are identical in general dimension. However, the placement of the shingles will vary depending upon the ultimate location of the triangular member.

Figure 4:
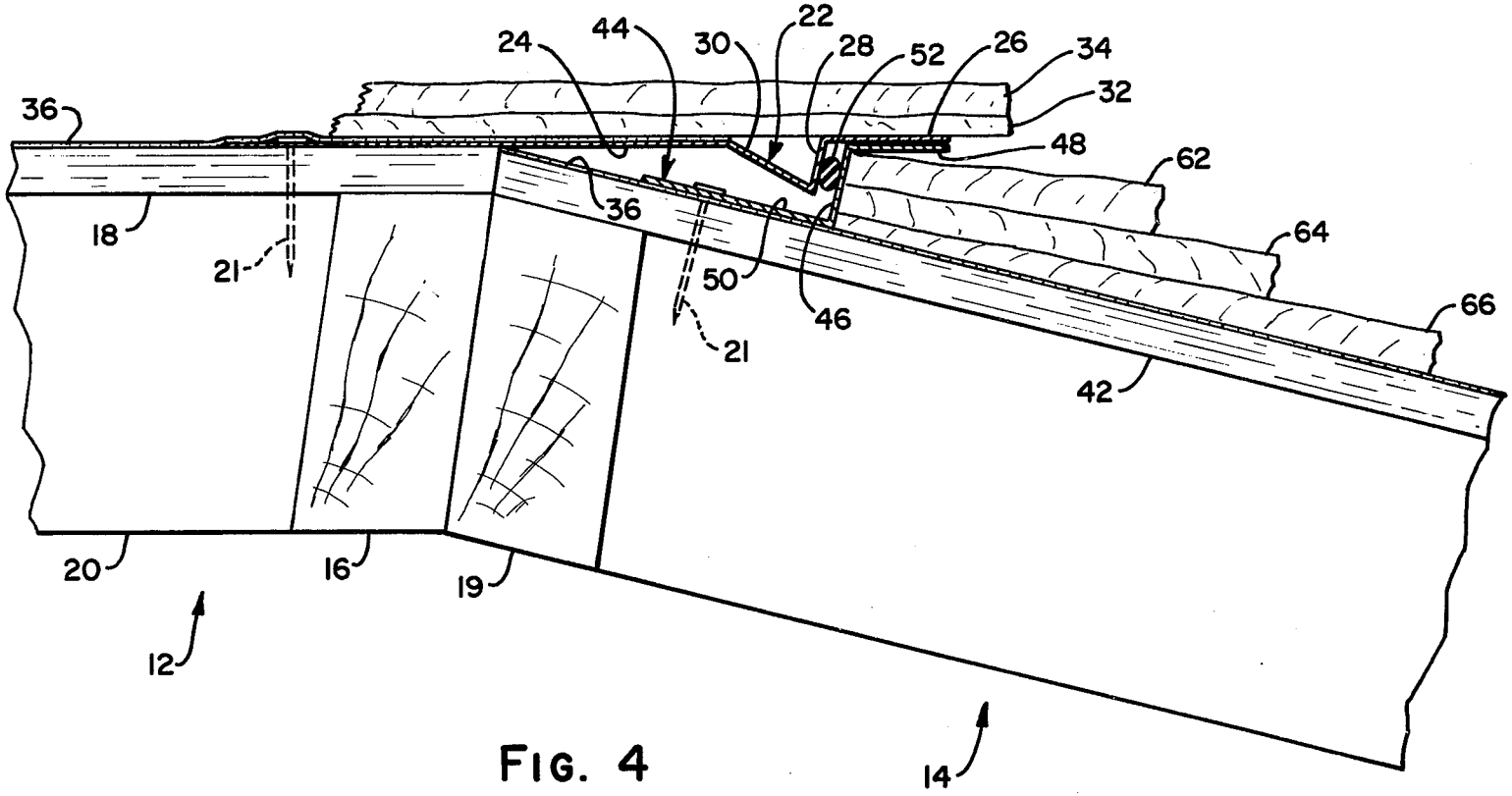
FIG. 4 is a sectional view taken along a plane perpendicular to the intersection between the first and second triangular sections illustrated in FIGS. 2 and 3.
Figure 5:
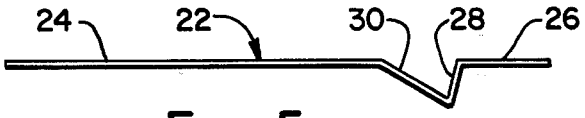
FIG. 5 is a side elevational view of a flashing member disposed on the first triangular member illustrated in FIG. 2.
Figure 7:
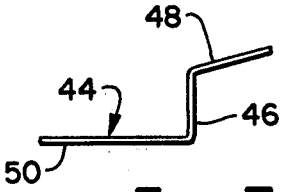
FIG. 7 is an elevational view of a second flashing member which is part of the second triangular member illustrated in FIG. 3.
Figure 6:
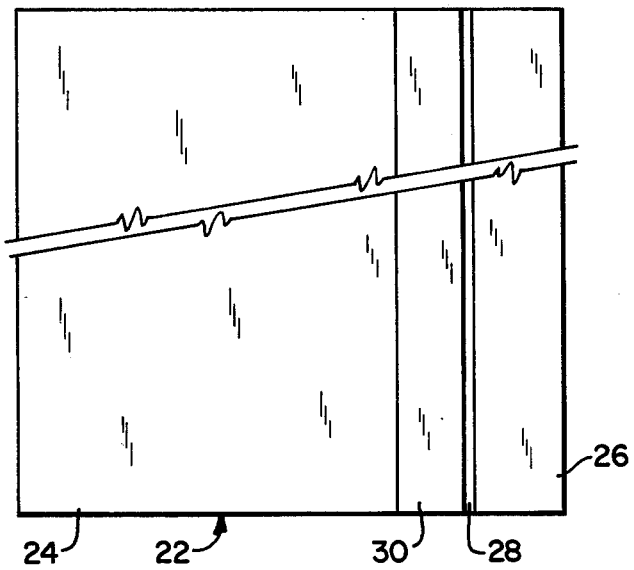
FIG. 6 is a plan view of the first flashing member illustrated in FIG. 5.
Figure 8:
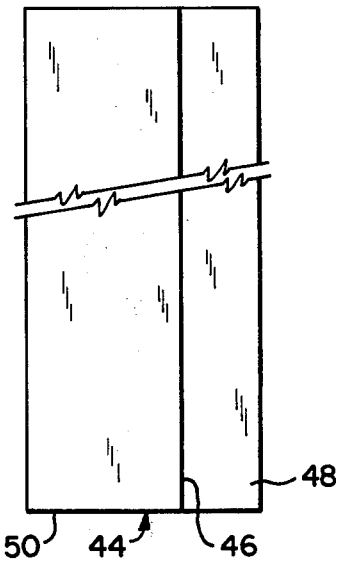
FIG. 8 is a plan view of the second flashing member illustrated in FIG. 7.
Figure 9:
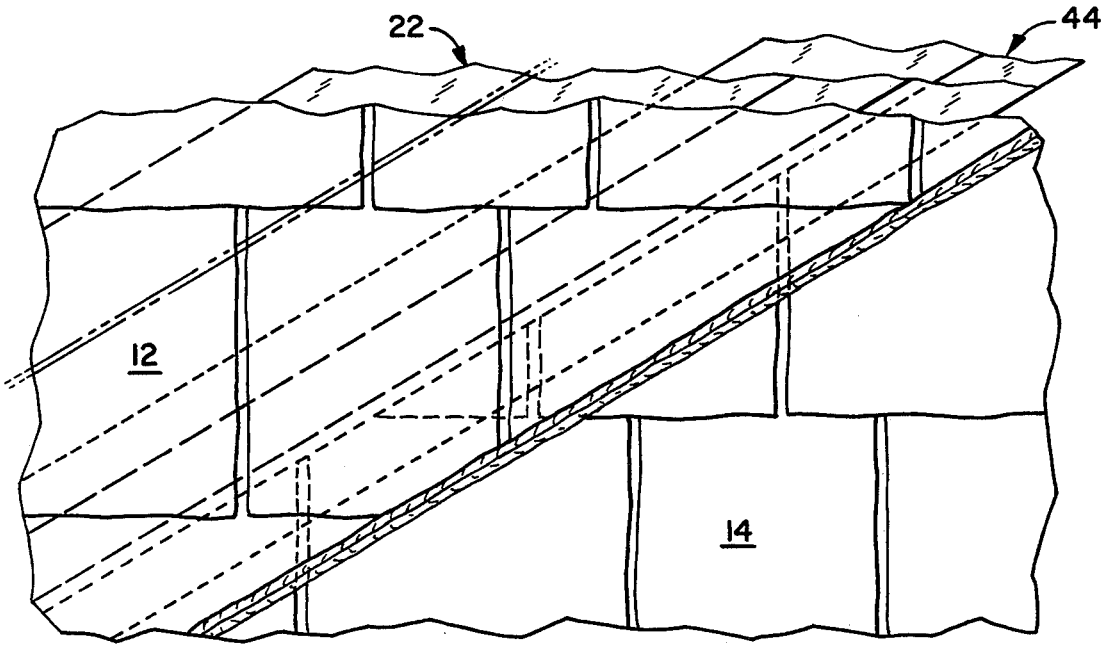
FIG. 9 is a fragmentary plan view illustrating the interface between the first and second triangular sections which is also shown in FIG. 4.

Referring now to FIGS. 2–9, a first triangular member 12 includes a framing member 16 which extends along and constitutes a first side. The first side 16 is tipped so as to be disposed at an angle of 14 degrees with respect to the ½ inch plywood face 18 of this triangular member. Two by four inch cross members 20 extend laterally across the first triangular member 12. A first flashing element 22, illustrated best in FIGS. 4, 5, and 6, is secured by nails 21 (one shown) to the first triangular member 12 and extends beyond the first side 16. The first flashing element 22 includes first and second generally planar surfaces 24, 26 which extend from a step shaped portion 28 which includes an obliquely extending portion 30 extending to the first generally planar surface 24. Cedar shingles 32, 34 are mounted on the generally triangular member 12 and extend beyond the first framing member 16 and also beyond the cantilevered first flashing 22. It will be understood that the shingles 32, 34 and other shingles which are not shown extend further to the left, than is shown in FIG. 4, in the actual construction. For simplicity these shingles have been omitted. Fifteen pound felt paper 36 is ordinarily applied over a portion of the flashing 22 and onto the plywood face 18 of the first triangular member 12.

The second triangular member 14 includes a framing member 19 which constitutes a second side thereof. The second side 19 is disposed at an angle of 14 degrees with respect to the ½ inch plywood face 42 thereof. A second flashing element 44 includes a step shaped section 46 which extends in aligned relationship with the second side 19 of the second generally triangular member 14. Nails 21 (one shown) are provided for holding the flashing element 44 to the second triangular member 14. The generally step shaped portion 46 is disposed intermediate generally planar portions 48 and 50. The generally planar portion 48 is disposed in generally oblique relationship to the face 42 of the second triangular member 14 and in parallel abutting planar contact with the generally planar portion 26 of the first flashing element 22. The seal 52 is disposed intermediate the nesting shaped portions 28 and 46 of respectively the second flashing element 44 and first flashing element 22. The seal 52 may be elastomeric or may be merely caulking material depending on the particular installation. Ordinarily, caulking material has been found to be adequate. Courses of shingles 62, 64, and 66 abut the step shaped portion 46 of the second flashing element 44.

It will be seen that the resulting cooperation of the first and second triangular members 12 and 14 results in a tight seal and facilitates the prefabrication of triangular members 12, 14 at a central factory so that they may be easily assembled at a job site.

Having thus described my invention I claim:

1. A building construction which includes:

a first member having a generally planar first side;

a second member having a generally planar side dimensioned and configured for engagement with said first side in abutting planar contact, said first and second members are generally planar and are disposed in oblique relationship;

a first flashing element disposed on said first member and extending along said first side, said first flashing element having a laterally extending step disposed intermediate first and second generally planar sections, said first generally planar section being fixed to said first element and said laterally extending step being disposed in generally parallel relationship to said first side, said first generally planar section of said first flashing element being disposed in oblique relationship to at least a part of said step shaped portion of said first flashing element;

a second flashing element disposed on said second member, said second flashing element including first and second generally planar surfaces disposed proximate to a step shaped section thereof, said step shaped portion thereof extending in generally parallel relationship to said second side, said step being disposed spaced away from said second side and above a portion of said second member; and said step shaped surface of said first flashing element is disposed in substantially nested relationship to said step shaped surface of said second flashing element.

2. The apparatus as described in claim 1, further including:

a course of shingles extending over said first flashing element which extends beyond said first member and beyond said first side.

3. The apparatus as described in claim 2, wherein:

said shingles are also disposed on said second member and said shingles on said second member extend in abutting relationship to said step shaped section of said second flashing element.

4. The apparatus as described in claim 3, wherein:

said first and second members are disposed with said second planar section of said first flashing element and said second planar section of said second flashing element in abutting planar contact.

5. The apparatus as described in claim 4, wherein:

means for sealing is disposed intermediate said step shaped section of said first flashing element and said step shaped section of said second flashing element.

6. The apparatus as described in claim 5, wherein:

said means for sealing comprises a strip of caulking material.

7. The apparatus as described in claim 5, wherein:

said means for sealing comprises an elastomeric seal.

* * * * *